United States Patent [19]

Van Alsburg

[11] 4,389,147

[45] Jun. 21, 1983

[54] CAN SUPPORT SYSTEM

[75] Inventor: Earl R. Van Alsburg, Barrington, Ill.

[73] Assignee: American Can Company, Greenwich, Conn.

[21] Appl. No.: 213,925

[22] Filed: Dec. 8, 1980

[51] Int. Cl.[3] ..... B21D 51/26

[52] U.S. Cl. ..... 413/69; 72/105; 72/106; 72/125; 72/370

[58] Field of Search ..... 72/125, 94, 105, 106, 72/370; 413/69

[56] References Cited

U.S. PATENT DOCUMENTS

| | | | |
|---|---|---|---|
| 2,686,551 | 8/1954 | Laxo . | |
| 3,062,263 | 11/1962 | Austing et al. . | |
| 3,490,404 | 1/1970 | Vanderlaand . | |
| 4,070,888 | 1/1978 | Gombas | 72/105 X |
| 4,176,536 | 12/1979 | Panknin | 72/105 |
| 4,308,737 | 1/1982 | Kannegiesser | 72/105 |
| 4,316,375 | 2/1982 | Lee | 72/105 |
| 4,341,103 | 7/1982 | Escallan | 72/105 |

*Primary Examiner*—Leon Gilden

*Attorney, Agent, or Firm*—Paul R. Audet; Aaron Passman; Stuart S. Bowie

[57] ABSTRACT

A mechanism for locating a hollow tubular can body relative to an internal support mandrel including a resilient member adapted to bear against a portion of the can body in order to positively locate same. Also included is a fixed relationship between the mandrel and support apparatus located on the machine whereby the biasing of the can body toward said support apparatus acts to adjust the axial position of the can body with respect to at least one of its surfaces.

8 Claims, 1 Drawing Figure

CAN SUPPORT SYSTEM

BACKGROUND OF THE DISCLOSURE

This invention relates to supporting a 2-piece container on a mandrel during a beading operation and, in particular, to a technique which assures the axial position of the container relative to the beading tool. Two-piece containers for packing comestibles are currently of interest in connection with replacement of the 3-piece sanitary food containers which were the standard of the industry for packaging foods. Three-piece containers are formed from a flat blank of sheet which is rolled and seamed along a longitudinal side by bonding, welding or soldering. The hollow cylindrical tube thus formed is capped at one end with an end closure by the manufacturer of the container. The end closure is held to the container by a hermetic double seam of interfolded metal along the periphery of the end closure and the hollow tubular cylinder.

It is common to precoat the blank before forming with plating or an organic coating to protect the food which is ultimately to be packed within the container from the harmful effects of the container or vice versa. With a 3-piece container a postcoating and/or side seam stripe is required to cover the areas damaged during manufacture by the body maker (which rolled the blank) or the side seaming processing.

In contrast, 2-piece containers are formed from precoated plate which is drawn into a cup-shape and if need be redrawn into a taller and narrower cup. Such drawn containers eliminate the need for forming or repairing side seams and overcome the concern about the quality or integrity of the double seamed bottom. That is to say that, the two pieces of the 2-piece container are the drawn container or cup and the end closure which the packer double seams hermetically to the top of the container after the comestibles are packed. No post or repair coatings are necessary for drawn containers. Precoats have been found which form adequately in connection with the drawing operation and yet maintain their integrity even after the converting of a flat sheet of precoated metal into an elongated cup-shape.

Most containers for packing comestibles are subject to processing conditions resulting from hot filling and/or retort processing. More specifically, hot food stuff is added to the container and the container is sealed. Upon cooling the internal pressure of the sealed container is less than the external atmospheric pressure. The pressure differential causes stress in the side walls of the hollow cylindrical container which must be adequately resisted by the strength of the container. Similarly, foods which are packed in a container which is then sealed and heated in a steam retort tend to expand during heating and then to shrink in volume during cooling. The later causes a lower internal pressure which results in even greater stress than those resulting from hot filling because the extremes are greater.

Should the filled and processed container be inadequate to resist the pressure differential, the side walls of the container will collapse inwardly forming panels which indicate the can has inadequate hoop stress resistance. One solution to this strength problem is to make the container of heavier gauge and harder or stronger materials. This solution is a problem in that the cost of the container and the difficulty of making same is increased. Another approach which has been used with great success has been to add a series of concentrically disposed side wall beads or corrugations which act to enhance the resistance to panelling. Beads are applied by certain techniques and can be used with either 2-piece or 3-piece containers.

One technique for applying beads to the side wall of a container is a system sold by REDICON, H & H Industries Inc., Dayton, Ohio, being a 12 Spindle Rotary Beader. This machine has a series of mandrels which support the drawn container and roll same across a fixed beading rail having grooves which match complimentary beading ribs disposed about the outer periphery of the mandrel. The mandrel has a smaller outer diameter than that of the interior diameter of the container and consequently when positioned within the container the axial center line of the mandrel is eccentric with respect to the axial center line of the container. When the mandrel and container carried thereon are rolled across the fixed beading rail the mandrel presses the container such that beads are formed between the ribs on the mandrel and the grooves on the rail.

Two or three-piece containers may have their beads placed specifically to generate a predetermined resistance to panelling. Even so, the specific location of the bead relative to the side wall varies somewhat from container to container. That is to say that, the position of the container relative to the mandrel will vary as a result of the shrinkage in overall can height due to beading and can height tolerances resulting from manufacturing. There are guide rails disposed normal to the axes of the mandrel and the container. These surfaces guide and align the container on to the mandrel before the container is brought into contact position against the beading rail.

Two-piece containers have a certain criticality with respect to where the beading is placed because the 2-piece containers include bottom chime-like beads which must be positioned at a predetermined axial relationship relative to the bottom of the container. More particularly, the beading mandrel used for 2-piece containers includes a bottom beader which is positioned at the most distal peripheral portion of the mandrel to cooperate with a similarly positioned groove on the fixed beading rail for generating a chime-like bottom bead. The chime-like bead is placed on each container so that it will be fully interchangeable with the 3-piece container which it seeks to replace. As already mentioned, the 3-piece container includes a double seamed bottom closure which is put on during the manufacture of the container. The double seamed bottom includes a double seam chime that gives the 3-piece container an outwardly extending circumferential lower periphery. Years of packaging and processing such containers have caused the industry to invest in equipment designed to handle such containers with the top and bottom peripheral double seam extensions. More particularly, the containers after packing and closure with a hermetically double seamed top are able to roll along can conveyors, during retort processes and into labelling equipment. Thus, the trackwork is adapted to cooperate with the chime surfaces of the double seams (top and bottom). It is a fact that such trackwork develops grooves as a result of the number of containers that have passed therethrough.

The 2-piece container therefore must have an accurately located chime-like lower bead to replace the missing chime of the double seamed bottom closure.

More particularly, the bead has to extend from the outer diameter of the container body side seam the same amount as would a double seamed chime and the longitudinal length of the bead should be equivalent of that of a double seamed chime. In order to have complete interchangeability a 2-piece container must support a label between the chime-like bead and the upper double seam in a manner identical to that which occurs in connection with a 3-piece container where the label rests between the upper and lower double seams.

It has been found that the tolerances between the backup rail and the mandrel flange of a conventional beader used for beading 3-piece containers, were troublesome with regard to 2-piece containers in that the bottom of the container was not positioned relative to the bottom beader portion of the mandrel. More specifically, the location of the chime-like bead was found to vary relative to its position with respect to the 2-piece container bottom. The present disclosure seeks to assure the positioning of the bottom chime-like bead by controlling the position of the 2-piece container relative to the beading mandrel.

Prior patent art discloses techniques for holding containers relative to the tools which are used for forming them. The McDonald U.S. Pat. No. 648,280 shows a combined beader and flanger having no specific system for precisely locating the beading relative to the side wall of the container. Similarly, the early patents to Lotz U.S. Pat. No. 632,840 and Coyle U.S. Pat. No. 1,912,258 disclose collapsible mandrels used for supporting the container during flanging, but fail to show any specific means for accurately axially positioning the container relative to the beading tool. Several arrangements are known for supporting containers of varying heights during double seaming or necking and flanging, see Black U.S. Pat. No. 858,785, Heinle U.S. Pat. No. 3,771,476 and Heinle U.S. Pat. No. 3,757,558 which disclose techniques for supporting the container bodies. These references are of interest to the improvement of the present disclosure but are inappropriate to the specific problem and the particular solution herein disclosed.

OBJECTS OF THE DISCLOSURE

It is the object of the present invention to provide a simple modification to a can beader mandrel which will permit same to accurately position the container during a beading operation.

It is a further object of the invention to provide an economical and reliable adaptation of an existing machine which will enable same to properly and accurately bead 2-piece containers.

It is still further the object of the invention to provide a resilient means designed to position the container on the beading mandrel.

SUMMARY OF THE DISCLOSURE

In accordance with the objects and in an effort to overcome the problem of accurately positioning the chime-like lower side wall bead, a modification to the beading mandrel not disclosed or suggested in the prior art has been developed. The modification includes a resiliently biased member adapted to cooperate with the open and flanged mouth of a 2-piece container body such that same is urged with respect to the mandrel toward the backup rail whereby the bottom of the container is held in contact with the backup rail. An annularly disposed stepped washer with a flange is carried about a groove on the base of the mandrel. The stepped washer is spring supported such that same is urged outwardly along the groove on the mandrel. Resilient members are positioned between the flange washer and the support for the mandrel. When a container is placed on the mandrel the container flange and open end rests upon the washer flange and is urged as a consequence. Sufficient travel of the washer is permitted along the mandrel groove to allow the stepped washer to accommodate the tolerances which are common in drawn containers. That is to say that, drawn containers will vary to some degree in their overall height as a consequence the side wall shortening due to beading and the manufacturing process conditions and tooling used during formation. This growth can be readily handled by the range of travel permitted and achieved with a resiliently biased stepped washer whereby containers of maximum and minimum allowed tolerances (for container bodies side wall height) will be accurately positioned relative to the backup rail such that the location of the lower chime-like bead is repeatable relative to the bottom of the container notwithstanding the variations in container height.

DETAILED DESCRIPTION OF THE DISCLOSURE

Figure 1:
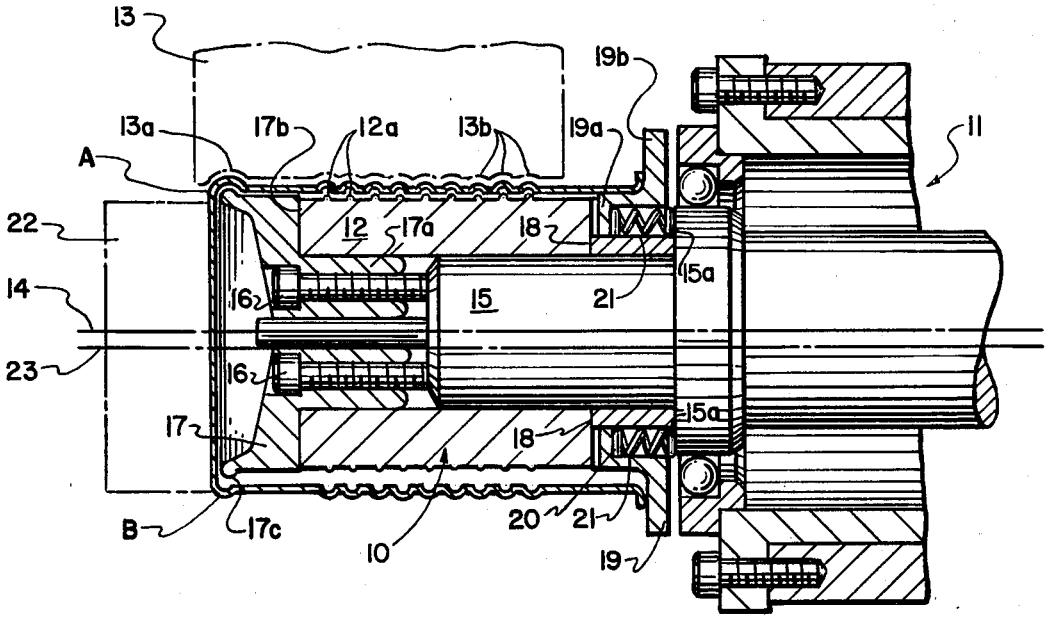
FIG. 1 is a side cross-sectional view of a modified beader mandrel having the invention of the present disclosure.

Turning now to FIG. 1, which shows a side cross-sectional view of the modified beader mandrel 10 for attachment to REDICON beader 11. About the body 12 of the beader mandrel 10 is disposed a 2-piece container A. Container A is captured between the body 12 and a fixed beading rail 13 in a manner well known. More specifically, however, the mandrel 10 is mounted for rotary movement about its longitudinal axis 14 (horizontal in FIG. 1) on a support lug 15 which is carried on a part of beader 11, the beader wheel (not completely shown). The lug 15 is a cylinder and is adapted to receive and support the body 12. That is to say that, the inner diameter of body 12 fits about the outer diameter of the end of lug 15. On the end of the lug 15 facing outwardly from the beader are threaded openings for receiving clamping bolts 16, which hold the body 12 axially on the lug 15. Bolts 16 bear against a clamping ring 17 which is adapted to fit into the inner diameter of body 12 at support portion **17*a* and bear against the distal face of the body 12 along inward ring face 17*b*. At the outward circumferential periphery of ring 17 is a toe-shaped portion 17*c*** arranged to generate the lower chime-like bead B on 2-piece container A.

Peripherically and concentrically about the outer diameter of body 12 are a series of beading ribs **12*a* which are shaped and positioned to form the beading in the cylindrical side wall of container A. The fixed beading rail 13 includes a series of complimentary grooves 13*b* which align with the ribs 12*a* forming the companion surface which operates to work the container A side wall during the rolling movement of beading mandrel 10. The groove which corresponds to the toe 17*c* is 13*a*** and it cooperates to generate the chime-like bead B.

A spacer 18 is located about the bottom periphery of lug 15 and spacer 18 acts to axially position the body 12 relative to the lug 15. More specifically, spacer 18 is a bushing which at one face bears against the body 12 and the other opposite face bears against a flange 15*a* on the base of lug 15. The outer diameter of spacer 18 is less than the outer diameter of the body 12 such that an annular groove is formed between the inward end of body 12 and the face of flange 15.

Positioned about spacer 18 for axial movement along the groove is a stepped washer 19 having an inner diameter portion 19*a* which fits about the outer diameter of spacer 18 and an extending outer flange 19*b* that faces axially outward from the beader 11. The hollow recess 20 formed in the space between the step of the washer 19 and the outer diameter of the bushing of the spacer 18 retains compression springs 21 each of which bears against flange 15*a* on its inner end and on an inside portion of washer 19 at its opposite outer end. Consequently, stepped washer 19 is resiliently biased toward body 12 by springs 21 and is supported for controlled axial movement on bushing 18 by the inner diameter portion 19*a*.

In operation the container A is fashioned in a press and transferred to a can conveyor which feeds the container A into the beader 11. There are series of mandrels 10 carried about the beader 11 along a circular path. Each mandrel 10 revolves about the center of the circular path in a manner well known and receives one drawn can and carries same as they revolve. A backup rail 22 is positioned to cam a container A inwardly onto a mandrel 10 until the container A is seated. In the past, the container A, would be allowed to rest freely between the backup rail 22 and an extension of flange 15*a*. More particularly, clearances between the backup rail 22 and the container A or the container A and the extension were not critical as long as the length of the container was less than the distance between the backup rail 22 and the extension 15*a*.

The present invention includes the resiliently biased stepped washer 19 which engages the flange of container A and forces same axially outward from the beader 11 such that the bottom of the container A is brought to lightly engage the backup rail 22. Thus, the positional relationship between the body 12 and the bottom of the container are identical from one container to the next. Notwithstanding variations in the overall axial length of the container. Normally, and as already mentioned, such variations arise as a result of the beading operation which in a typical sanitary food can reduces the side wall length about 0.0045" per bead and as a part of the manufacturing process of drawing a cup shaped container. It will be noted that the center line 14 of the mandrel 10 and the center line 23 of the container A are parallel and not coaxial; this is because the mandrel 10 is smaller in outer diameter than the inner diameter of the container A. As is common with such beaders, the revolving mandrel 10 also rotates or spins about its axis 14 and causes the container A to be rolled between the mandrel body 12 and the fixed beading rail 13.

Those skilled in the can manufacturing arts will no doubt appreciate that various modifications and alterations could be made to the structure disclosed and herein explained. More specifically, the type of spring used could include resilient materials or flexible washers which would act to achieve the same accommodations of the varying longitudinal dimension of container A. Also the position of the biasing member could be modified such that it were a part of the backup rail or a combination of the backup rail and the beader support flange. What is sought to be protected in this patent is any biasing arrangement which will repeatedly locate the container bottom axially relative to the beader mandrel whereby the beading will be positioned on similar containers at the same longitudinal location along the side wall of each container. Similar containers are those which have the same diameter and height to one another such that apart from ordinary manufacturing tolerances are identical to one another.

What is claimed is:

1. A method for holding a hollow generally cylindrical tubular body over a mandrel in a prescribed axial relationship to said mandrel during a forming operation in which the side wall of said body is beaded including the following steps:

inserting said tubular body over a mandrel by coaxially aligning said body and said mandrel and camming said body on to said mandrel, engaging the innermost end of said body opposite to the camming end and urging same outwardly relative to said mandrel for locating at a prescribed distance the cammed body end with respect to the outward end of said mandrel adjacent said camming device, and radially reforming the side wall of said body to include a series of annular convolutions including a chime-like one positioned near the cammed end of said body said chime-like convolution being a preset distance from the bottom of said body.

2. A modified beading mandrel being one of a series of mandrels that support drawn 2-piece containers to roll same across a fixed beading rail having grooves which match complimentary ribs about the periphery of the mandrel where the outer diameter thereof is smaller than the inner diameter of the container such that the axial center line of the mandrel is eccentric with respect to that of the container comprising:

(a) a generally cylindrical member having an elongated shape with a supported end and an extended end opposite thereto, and a cylindrical body therebetween, said member mounted at its support end and carried along its axis for rotary movement thereabout and relative to its support;

(b) a spacer bushing of cylindrical configuration and reduced diameter relative to said body and being a part of said body and located near said support end thereof for defining a reduced diameter portion of said body along its axis and close to but axially apart from said support;

(c) resilient means carried about said spacer bushing with an end thereof against said body support end and being carried in position for axial compression, and (d) a washer having a radially extending flange and being carried about said spacer bushing of said mandrel member body for reciprocatory axial movement therealong as urged by said resilient means as said flange is engaged with a portion of a container body carried about said member for causing axial movement thereof outward axially of said member toward a backup rail.

3. A modified beading mandrel according to claim 2 wherein said body is ribbed about its periphery.

4. A modified beading mandrel according to claim 3 wherein said washer is stepped axially to form a hollow recess between it and said spacer bushing to contain said resilient means.

5. A modified beading mandrel according to claim 4 wherein said recess contains a plurality of compression springs which bear against said support end of said body for urging said washer axially toward said extended end.

6. A modified beading mandrel according to claim 5 wherein said extended end of said body includes a toe-shaped portion reaching radially outward therefrom for generating a lower chime-like bead on a container.

7. A modified beading mandrel according to claim 6 wherein said stepped washer flange engages the open end of a container.

8. A modified beading mandrel according to claim 7 wherein said member is one of many carried on a rotary beader having a prepherially located beading rail with companion convolutions for said ribs and toe-shape portions.

* * * * *